US011270656B2

(12) United States Patent
Cui et al.

(10) Patent No.: US 11,270,656 B2
(45) Date of Patent: Mar. 8, 2022

(54) CONTROL METHOD AND DEVICE OF BACKLIGHT, DISPLAY METHOD AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Ziwei Cui, Beijing (CN); Linlin Lu, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 318 days.

(21) Appl. No.: 16/607,121

(22) PCT Filed: May 27, 2019

(86) PCT No.: PCT/CN2019/088603

§ 371 (c)(1),
(2) Date: Oct. 22, 2019

(87) PCT Pub. No.: WO2019/228308

PCT Pub. Date: Dec. 5, 2019

(65) Prior Publication Data

US 2021/0335286 A1 Oct. 28, 2021

(30) Foreign Application Priority Data

May 28, 2018 (CN) ..... 201810524489.0

(51) Int. Cl.
*G09G 3/36* (2006.01)
*G09G 3/34* (2006.01)

(52) U.S. Cl.
CPC ..... *G09G 3/3406* (2013.01); *G09G 3/3614* (2013.01); *G09G 2310/08* (2013.01); *G09G 2320/064* (2013.01)

(58) Field of Classification Search
CPC ..... G09G 3/3406; G09G 3/3614; G09G 2310/08; G09G 2320/064
See application file for complete search history.

(56) References Cited

U.S. PATENT DOCUMENTS

| | | | | |
|---|---|---|---|---|
| 2014/0226095 | A1 | 8/2014 | Scott et al. | |
| 2016/0078830 | A1 | 3/2016 | Huang et al. | |
| 2019/0207638 | A1* | 7/2019 | Zhang | H04M 1/04 |
| 2021/0225299 | A1* | 7/2021 | Xi | G09G 5/10 |

FOREIGN PATENT DOCUMENTS

| | | |
|---|---|---|
| CN | 101105915 | 1/2008 |
| CN | 101221734 | 7/2008 |
| CN | 105489170 | 4/2016 |
| CN | 108735169 | 11/2018 |
| JP | 2015166755 | 9/2015 |

* cited by examiner

*Primary Examiner* — Vijay Shankar
(74) *Attorney, Agent, or Firm* — Leason Ellis LLP

(57) ABSTRACT

A control method for a backlight, a control device for a backlight, a display method and a display device are disclosed. The control method for the backlight includes: generating a control signal for the backlight based on a first backlight signal and a second backlight signal, wherein the first backlight signal is different from the second backlight signal. The control method for the backlight can improve the display effect of the display device adopting the control method.

15 Claims, 3 Drawing Sheets

CONTROL METHOD AND DEVICE OF BACKLIGHT, DISPLAY METHOD AND DISPLAY DEVICE

CROSS REFERENCE TO RELATED APPLICATIONS

This application is a U.S. National Stage Application under 35 U.S.C. § 371 of International Patent Application No. PCT/CN219/088603, filed May 27, 2019, which claims priority to Chinese patent application No. 201810524489.0, filed on May 28, 2018, both of which are incorporated by reference in their entireties as part of the present application.

TECHNICAL FIELD

Embodiments of the present disclosure relate to a control method for a backlight, a control device for a backlight, a display method and a display device.

BACKGROUND

A liquid crystal display (LCD) device comprises a backlight and an LCD panel, and the backlight is disposed, for example, on a non-display side of the LCD panel to provide a light source for the display operation of the display panel. The LCD panel includes a polarizer, an array substrate, an opposed substrate, and a liquid crystal molecule layer filled between the two substrates. The LCD device rotates liquid crystal molecules in the liquid crystal molecular layer by forming an electric field between the array substrate and the opposed substrate, and the rotated liquid crystal molecules are combined with the polarizer to form a liquid crystal light valve. Because the liquid crystal molecule layer does not emit light, it is necessary to realize the display function via the backlight. Virtual reality (VR) technology is widely applied gradually. Taking a VR device as an example, it's usually used by users to watch movies, play video games and other entertainment activities.

SUMMARY

At least one embodiment of the present disclosure provides a control method for a backlight, which comprises: generating a control signal for the backlight based on a first backlight signal and a second backlight signal. The first backlight signal is different from the second backlight signal.

For example, in at least one example of the control method, the control method further comprises: controlling the first backlight signal and the second backlight signal according to a display mode of a display panel provided with the backlight, so as to enable the control signal for the backlight to be switched between a black frame insertion (BFI) control signal and a brightness control signal.

For example, in at least one example of the control method, the first backlight signal and the second backlight signal comprise at least one of the BFI control signal and the brightness control signal.

For example, in at least one example of the control method, if the display mode is a first mode, the first backlight signal is the BFI control signal and the second backlight signal is a first cooperation signal; generating the control signal for the backlight based on the first backlight signal and the second backlight signal comprises: executing a logical operation based on the BFI control signal and the first cooperation signal, here a result of the logical operation is the BFI control signal. If the display mode is a second mode, the first backlight signal is a second cooperation signal and the second backlight signal is the brightness control signal; and generating the control signal for the backlight based on the first backlight signal and the second backlight signal comprises: executing a logical operation based on the second cooperation signal and the brightness control signal, here a result of the logical operation is the brightness control signal.

For example, in at least one example of the control method, voltage values of the first cooperation signal and the second cooperation signal are all at a first voltage level, and the logical operation is an "AND" operation; or voltage values of the first cooperation signal and the second cooperation signal are all at a second voltage level, and the logical operation is an "OR" operation. A voltage value of the second voltage level is less than a voltage value of the first voltage level.

For example, in at least one example of the control method, the control method further comprises: providing the first backlight signal and the second backlight signal to a logical operation circuit. The logical operation circuit is configured to generate the control signal for the backlight by utilization of a logical operation based on the first backlight signal and the second backlight signal.

For example, in at least one example of the control method, controlling the first backlight signal and the second backlight signal according to the display mode of the display panel provided with the backlight comprises: generating a first control signal and a second control signal according to the display mode.

For example, in at least one example of the control method, controlling the first backlight signal and the second backlight signal according to the display mode of the display panel provided with the backlight further comprises: allowing a first signal receiving terminal of a drive circuit of the display panel to receive the first control signal; and allowing the drive circuit of the display panel to generate the first backlight signal based on at least the first control signal.

For example, in at least one example of the control method, allowing the drive circuit of the display panel to generate the first backlight signal based on at least the first control signal comprises: allowing the drive circuit of the display panel to be configured to enable the first backlight signal to be switched between the BFI control signal and a second cooperation signal based on at least the first control signal.

For example, in at least one example of the control method, in a time period corresponding to each frame of image of the display panel, the BFI control signal is a single-pulse signal or a double-pulse signal; a pulse duration period of the BFI control signal and a transmittance adjustment period of a liquid crystal cell of the display panel are not overlapped in time; and the second cooperation signal is a first constant voltage signal.

For example, in at least one example of the control method, in a case where the BFI control signal is the single-pulse signal, a starting time point of the single-pulse signal is equal to or later than a transmittance adjustment end time point of the liquid crystal cell of the display panel; in a case where the BFI control signal is the double-pulse signal, the double-pulse signal comprises a first pulse and a second pulse; an end time point of the first pulse is same as or earlier than a transmittance adjustment starting time point of the liquid crystal cell of the display panel; and a starting time point of the second pulse is equal to or later than a transmittance adjustment end time point of the liquid crystal cell of the display panel.

For example, in at least one example of the control method, the brightness control signal comprises a pulse width modulation (PWM) signal with an adjustable duty ratio; a first cooperation signal is a second constant voltage signal; controlling the first backlight signal and the second backlight signal according to the display mode of the display panel provided with the backlight further comprises: adjusting the duty ratio of the PWM signal based on the second control signal; and the control method further comprises: providing the brightness control signal to a second signal receiving terminal of the drive circuit of the display panel.

For example, in at least one example of the control method, the first mode is a smearing suppression mode and the second mode is a brightness adjustment mode.

For example, in at least one example of the control method, the control method further comprises: acquiring the display mode of the display panel before generating the control signal for the backlight based on the first backlight signal and the second backlight signal.

At least one embodiment of the present disclosure further provides a display method, which comprises: executing the control method provided by any one embodiment of the present disclosure to acquire the control signal for the backlight; and driving the backlight based on the control signal for the backlight to enable a display panel to perform display operation.

At least one embodiment of the present disclosure further provides a control device for a backlight, the control device for the backlight is configured to: generate a control signal for the backlight based on a first backlight signal and a second backlight signal. The first backlight signal is different from the second backlight signal.

For example, in at least one example of the control device, the control device for the backlight is further configured to: control the first backlight signal and the second backlight signal according to a display mode of a display panel provided with the backlight, so as to enable the control signal for the backlight to be switched between a black frame insertion (BFI) signal and a brightness control signal.

For example, in at least one example of the control device, the control device further comprises: a processor, a logical operation circuit and a drive circuit. The processor is configured to generate a first control signal; the drive circuit comprises a first signal input terminal, a second signal input terminal, a first signal output terminal and a second signal output terminal; the first signal input terminal of the drive circuit is configured to receive the first control signal, and the second signal input terminal of the drive circuit is configured to receive the second backlight signal; the drive circuit is configured to generate the first backlight signal based on at least the first control signal;

the first signal output terminal of the drive circuit is connected with a first signal input terminal of the logical operation circuit, so as to enable the first backlight signal to be provided to the first signal input terminal of the logical operation circuit; the second signal output terminal of the drive circuit is connected with a second signal input terminal of the logical operation circuit, so as to enable the second backlight signal to be provided the second signal input terminal of the logical operation circuit; the logical operation circuit is configured to generate the control signal for the backlight by utilization of a logical operation based on the first backlight signal and the second backlight signal; and a signal input terminal of the backlight is connected with a signal output terminal of the logical operation circuit, so as to receive the control signal for the backlight.

At least one embodiment of the present disclosure further provides a display device, which comprises: the control device for the backlight provided by any one embodiment of the present disclosure.

At least one embodiment of the present disclosure further provides another display device, which comprises a drive device for a backlight. The drive device for the backlight is configured to generate a control signal for the backlight based on a first backlight signal and a second backlight signal. The first backlight signal is different from the second backlight signal.

For example, in at least one example of the display device, the drive device for the backlight is further configured to control the first backlight signal and the second backlight signal according to a display mode of a display panel provided with the backlight, so as to enable the control signal for the backlight to be switched between a black frame insertion (BFI) control signal and a brightness control signal.

For example, in at least one example of the display device, the display device further comprises a determination unit. The determination unit is configured to determine the display mode of the display panel; the drive device for the backlight comprises: a first mode control unit, a second mode control unit, a signal calculation unit and a backlight drive circuit; the first mode control unit is configured to control the first backlight signal to be the BFI control signal and the second backlight signal to be a first cooperation signal if the display mode is a first mode; the second mode control unit is configured to control the first backlight signal to be a second cooperation signal and the second backlight signal to be the brightness control signal if the display mode is a second mode; the signal calculation unit is configured to: obtain the control signal for the backlight through calculating with a pre-defined algorithm according to the first backlight signal and the second backlight signal, so as to enable the backlight to be capable of being driven based on the control signal for the backlight; the BFI control signal and the first cooperation signal are configured to obtain the control signal, which is the BFI control signal, for the backlight through calculating with a pre-defined algorithm, here the control signal for the backlight is the BFI control signal; and the brightness control signal and the second cooperation signal are configured to obtain the control signal, which is the brightness control signal, for the backlight through calculating with a pre-defined algorithm.

BRIEF DESCRIPTION OF THE DRAWINGS

In order to clearly illustrate the technical solution of the embodiments of the disclosure, the drawings used in the description of the embodiments or relevant technologies will be briefly described in the following; it is obvious that the described drawings are only related to some embodiments of the disclosure and thus are not limitative of the disclosure.

DETAILED DESCRIPTION

Figure 1:
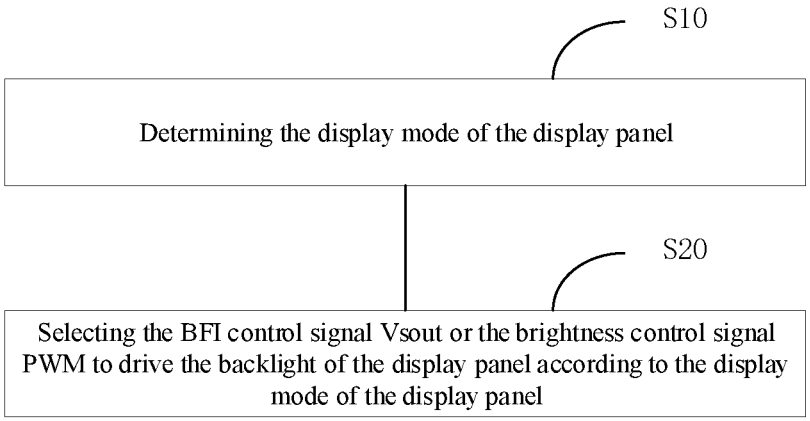
FIG. 1 is a schematic flowchart of a control method and a display method of a backlight provided by at least one embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The inventors of the present disclosure have noted in research that a display device (liquid crystal display device) has smearing problem, which will lower the sharpness of a picture displayed by the display device. The inventors of the present disclosure have also noted in study that although the smearing problem of the liquid crystal display (LCD) device can be suppressed by employing a method of turning on the backlight of the LCD device after the transmittance adjustment of the LCD panel is completed, however, the brightness of the LCD device can be reduced, and the display effect of the display device can be reduced as well. The inventors of the present disclosure have also noted in study that, although it is possible to adjust the brightness of the display device including the backlight by adoption of a pulse width modulation (PWM) signal to drive the backlight, it is difficult to combine the technical solution of suppressing smearing problem and the technical solution for increasing the brightness of the display device. Illustrative description will be given below via an example.

For example, the display brightness of a display screen of a virtual reality (VR) head-mounted device may be controlled by a backlight output signal (e.g., a control signal for a backlight) provided (output) by an image processor (e.g., a video processor); the backlight output signal usually adopts a PWM signal; a PWM signal corresponding to one frame of display image of the display device includes a plurality of pulses (e.g., square wave pulses); the ratio of the pulse width of each pulse to the PWM signal period (the reciprocal of the frequency of the PWM signal) is referred to as a duty ratio; and when the duty ratio is larger, the display brightness of the display is higher. For example, the use of the PWM signal can satisfy the user's need for brightness (high brightness requirement) when watching a movie. However, in the display of an electronic game scene by adoption of the display device employing the PWM signal, the display device can have a relatively serious (user-aware) smearing phenomenon, thereby making the user's game experience poor.

At least one embodiment of the present disclosure provides a control method for a backlight, a control device for a backlight, a display method and a display device. The control method for the backlight comprises: generating a control signal for the backlight (e.g., a control signal for driving the backlight) based on a first backlight signal and a second backlight signal. The first backlight signal is different from the second backlight signal. The control method for the backlight can improve the display effect of the display device employing the control method for the backlight.

In some examples, the control method further comprises: controlling the first backlight signal and the second backlight signal according to the display mode of a display panel provided with the backlight, so as to switch the control signal for the backlight between a black frame insertion (BFI) control signal and a brightness control signal. In some examples, the first backlight signal and the second backlight signal include at least one of the BFI control signal and the brightness control signal.

For example, by allowing the control signal for driving the backlight of the display panel to switch between the BFI control signal and the brightness control signal, the display device employing the control method for the backlight can have smearing suppression function under a smearing suppression mode (for example, a game mode), and have higher brightness under a brightness adjustment mode (for example, a viewing mode), thereby improving the display effect and the use experience of the display device employing the control method for the backlight.

Non-limitative descriptions are given to the control method for the backlight provided by at least an embodiment of the present disclosure in the following with reference to a plurality of examples or embodiments. As described in the following, in case of no conflict, different features in these specific examples or embodiments may be combined so as to obtain new examples or embodiments, and the new examples or embodiments are also fall within the scope of present disclosure.

At least one embodiment of the present disclosure provides a control method for a backlight and a display method (for example, a video display method). To simplify the description, the control method for the backlight and the display method will be simultaneously described.

For example, the control method for the backlight comprises: generating a control signal for the backlight based on a first backlight signal and a second backlight signal. The first backlight signal is different from the second backlight signal.

For example, the control method further comprises: controlling the first backlight signal and the second backlight signal according to the display mode of a display panel provided with the backlight, so as to adopt (for example, switch between) a BFI control signal Vsout or a brightness control signal PWM to drive the backlight of the display panel, that is, switching the control signal for driving the backlight of the display panel between the BFI control signal Vsout and the brightness control signal PWM according to the display mode of the display panel, and driving the backlight based on the control signal for the backlight. For example, when the display mode is a first mode (for example, a game mode, a smearing suppression mode), the BFI control signal Vsout may be adopted as the control signal for driving the backlight of the display panel, so the smearing problem of a display image (for example, a game image) can be reduced. For example, when the display mode is a second mode (for example, a viewing mode, a brightness adjustment mode), the brightness control signal PWM may be taken as the control signal for driving the backlight of the display panel, so the display brightness of a display image (e.g., a movie image) can be adjusted (for example, improved). For example, by adopting (for example, switching), according to the display mode of the display panel, the BFI control signal Vsout or the brightness control signal PWM to drive the backlight of the display panel, the same display device can satisfy users' double requirements on high brightness of movie and no smearing of game (by adoption of different display modes). It should be noted that in some examples, the control method for the backlight may also not comprise: driving the backlight based on the control signal for the backlight. In this case, the step of driving the backlight based on the control signal for the backlight can be executed in the image display method.

It should be noted that in some examples, the brightness adjustment mode may be brightness enhancement mode (compared with the first mode or the game mode); and in some other examples, the brightness adjustment mode may also be brightness reduction mode.

For example, in the time period corresponding to each frame of image of the display panel, the pulse duration period of the BFI control signal Vsout and the transmittance adjustment period of a liquid crystal cell of the display panel are not overlapped in time, that is, the backlight is turned on when the transmittance of the liquid crystal cell is kept unchanged (for example, the liquid crystal molecules of the liquid crystal cell do not rotate).

In some examples, because the pulse duration period of the BFI control signal Vsout and the transmittance adjustment period of the liquid crystal cell of the display panel are not overlapped in time, the smearing problem of the display device employing the control method for the backlight can be suppressed. In some examples, the potential spinning sensation of the user during the liquid crystal rotation period can also be suppressed.

Figure 8:
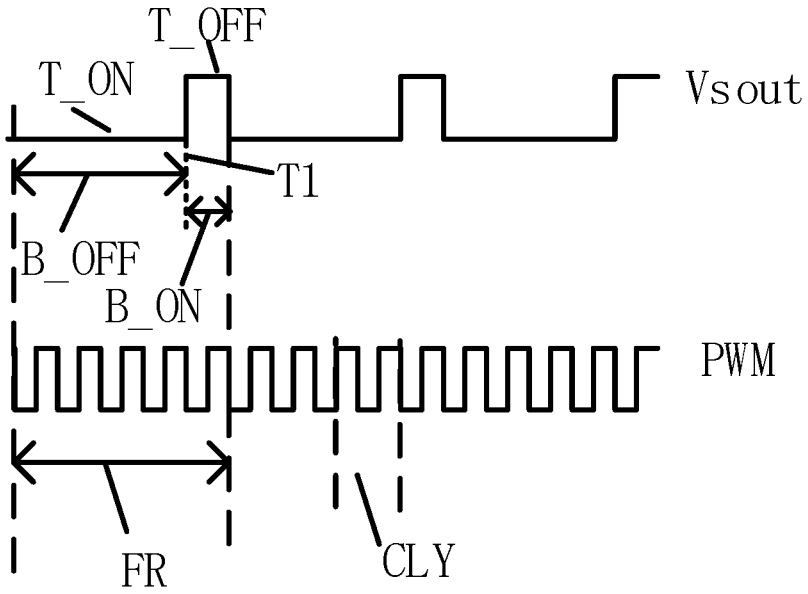
FIG. 8 is a schematic diagram of a black frame insertion (BFI) control signal and a brightness control signal in at least one embodiment of the present disclosure.

For example, as illustrated in FIG. 8, the BFI control signal Vsout may be a single-pulse signal: the transmittance adjustment period of the liquid crystal cell is T_ON, and the transmittance maintaining period of the liquid crystal cell is T_OFF. For example, the transmittance adjustment period of the liquid crystal cell may correspond to the period of performing progressive scanning on gate lines in a display region of the display device, and the transmittance maintaining period of the liquid crystal cell T_OFF may correspond to the period of performing progressive scanning on dummy gate lines (for example, disposed below the gate lines in the display region of the display device) in a non-display region of the display device.

For example, as illustrated in FIG. 8, the time period of allowing the backlight to be turned on (that is, the backlight is in the on state) is B_ON, and the time period of turning off the backlight (that is, the backlight is in the off state) is B_OFF. For example, the period B_OFF of turning off the backlight corresponds to the BFI period a in the example as illustrated in FIG. 1 and the transmittance adjustment period T_ON of the liquid crystal cell, and the period B_ON of allowing the backlight to be turned on corresponds to the display period b and the transmittance maintaining period T_OFF of the liquid crystal cell. For example, the ratio of the period of allowing the backlight to be turned on to the time of one frame of display image of the display device is about 5%-25% (for example, 10%, 15% or 20%).

For example, as illustrated in FIG. 8, the starting time T1 of the single-pulse signal for turning on the backlight is equal to the transmittance adjustment end time T1 of the liquid crystal cell of the display pane. In this case, the display brightness reduction value of the display device employing the control method for the backlight can be reduced.

The following two points should be noted.

(1) The starting time point of the pulse signal may also be later than the transmittance adjustment end time point of the liquid crystal cell of the display panel according to application demands.

(2) According to application demands, the BFI control signal Vsout may also be a double-pulse signal. In this case, dummy gate lines are, for example, disposed above and below the gate lines in the display region of the display device, and the backlight is turned on before the transmittance adjustment starting time point of the liquid crystal cell and after the transmittance adjustment end time point of the liquid crystal cell. The double-pulse signal includes a first pulse and a second pulse. The end time point of the first pulse (not shown) is equal to or earlier than the transmittance adjustment starting time point of the liquid crystal cell of the display panel, and the starting time point of the second pulse (not shown) is equal to or later than the transmittance adjustment end time point of the liquid crystal cell of the display panel.

For example, the brightness control signal PWM includes a PWM signal with an adjustable duty ratio (a multi-pulse signal), and the duty ratio of the PWM signal is the ratio of the pulse width of each pulse to the PWM signal period CLY (the reciprocal of the frequency of the PWM signal). For example, the duty ratio of the brightness control signal PWM is greater than 0 and less than 1. For example, the PWM signal is also referred to as adjustable pulse width signal.

For example, the first backlight signal and the second backlight signal may be provided to a logical operation circuit (for example, a "OR" operation circuit or a "AND" operation circuit); and the logical operation circuit is configured to generate the control signal for the backlight by utilization of logical operation (for example, "OR" operation or "AND" operation) based on the first backlight signal and the second backlight signal.

In some examples, the first backlight signal and the second backlight signal include at least one of the BFI control signal and the brightness control signal.

For example, if the display mode is the first mode (e.g., smearing suppression mode), the first backlight signal may be the BFI control signal Vsout and the second backlight signal may be a first cooperation signal, and the step of generating the control signal for the backlight based on the first backlight signal and the second backlight signal includes: executing logical operation based on the BFI control signal Vsout and the first cooperation signal; here, the result of the logical operation is the BFI control signal Vsout. For example, if the display mode is the second mode (for example, brightness adjustment mode), the first backlight signal is a second cooperation signal and the second backlight signal is the brightness control signal, and the step of generating the control signal for the backlight based on the first backlight signal and the second backlight signal includes: executing logical operation based on the second cooperation signal and the brightness control signal; here, the result of the logical operation is the brightness control signal. For example, both the first cooperation signal and the second cooperation signal may be a constant voltage signal.

For example, when the voltage values of the first cooperation signal and the second cooperation signal are all at a first voltage level, the control signal for the backlight is generated based on "AND" operation, that is, the logical operation is "AND" operation, and in this case, the first backlight signal and the second backlight signal can be provided to an "AND" operation circuit (e.g., an AND gate). For example, the description that the voltage values of the first cooperation signal and the second cooperation signal are all at the first voltage level refers to that: the voltage values of the first cooperation signal and the second cooperation signal are all at a high voltage level (namely a voltage value greater than a first voltage threshold or a voltage value corresponding to logic "1"), and the voltage value of the first cooperation signal and the voltage value of the second cooperation signal may be same or different.

For example, when the voltage values of the first cooperation signal and the second cooperation signal are all at a second voltage level, the control signal for the backlight is generated based on "OR" operation, that is, the logical operation is "OR" operation, and in this case, the first backlight signal and the second backlight signal can be provided to an "OR" operation circuit (for example, an OR gate). For example, the description that the voltage values of the first cooperation signal and the second cooperation signal are all at the second voltage level refers to that: the voltage values of the first cooperation signal and the second cooperation signal are all at the low voltage level (that is, a voltage value greater than a second voltage threshold or a voltage value corresponding to logic "0"), and the voltage value of the first cooperation signal and the voltage value of the second cooperation signal may be same or different. For example, the voltage value of the second voltage level is less than the voltage value of the first voltage level, and the voltage value of the second voltage threshold is less than the voltage value of the first voltage threshold.

It should be noted that the first voltage level and the second voltage level in other examples or embodiments of the present disclosure also have similar definitions, and are not described again.

For example, the step of controlling the first backlight signal and the second backlight signal according to the display mode of the display panel provided with the backlight includes the following steps S101-S104.

S101: allowing a processor (e.g., an image processor) to generate a first control signal and a second control signal according to the display mode.

S102: allowing the second backlight signal to be the first cooperation signal or the PWM signal based on the second control signal. When the second backlight signal is the PWM signal, the step S102 further includes: adjusting the duty ratio of the PWM signal based on the second control signal.

S103: allowing a first signal receiving terminal of a drive circuit of the display panel to receive a first control signal, and allowing a second signal receiving terminal of the drive circuit of the display panel to receive the second backlight signal.

S104: allowing the drive circuit of the display panel to at least generate the first backlight signal based on the first control signal. For example, the step of allowing the drive circuit of the display panel to at least generate the first backlight signal based on the first control signal includes: allowing the drive circuit of the display panel to at least switch the first backlight signal between the BFI control signal Vsout and the second cooperation signal based on the first control signal.

For example, the control method for the backlight further comprises the following step S105.

S105: providing the first backlight signal and the second backlight signal to a first signal input terminal and a second signal input terminal of the logical operation circuit via the first signal receiving terminal and the second signal receiving terminal of the drive circuit.

For example, when the display mode is the first display mode (for example, smearing suppression mode), the second backlight signal is allowed to be the first cooperation signal based on the second control signal; the first cooperation signal is substantially a constant voltage signal (for example, a high voltage level signal or a low voltage level signal) and is outputted through a second signal output terminal of the drive circuit of the display panel; and a memory (for example, a register) of the drive circuit of the display panel may output the BFI control signal Vsout from the first signal output terminal of the drive circuit of the display panel. For example, the duty ratio (namely the ratio of the value of the time period B_ON of allowing the backlight to be turned on to the value of the time period of one frame of display image FR) of the BFI control signal Vsout outputted from the first signal output terminal of the drive circuit may be adjusted within the range of 0-25% according to the first control signal (for example, equal to 10%). For example, the BFI control signal Vsout and the first cooperation signal (for example, high voltage level signal) are respectively provided to a first signal input terminal and a second signal input terminal of the "AND" operation circuit via the first signal output terminal of the drive circuit and the second signal output terminal of the drive circuit, so that the BFI control signal Vsout taken as the control signal for the backlight can be generated after the "AND" operation circuit performs "AND" operation on the BFI control signal Vsout and the first cooperation signal (for example, high voltage level signal). For example, in this case, the BFI control signal Vsout outputted by the "AND" operation circuit is completely the same as the BFI control signal Vsout received by the "AND" operation circuit. For another example, the BFI control signal Vsout and the first cooperation signal (for example, low voltage level signal) may be respectively provided to a first signal input terminal and a second signal input terminal of an "OR" operation circuit via the first signal output terminal of the drive circuit and the second signal output terminal of the drive circuit. Thus, the BFI control signal Vsout taken as the control signal for the backlight can be generated after the "OR" operation circuit performs "OR" operation on the BFI control signal Vsout and the first cooperation signal (for example, low voltage level signal). For example, in this case, the BFI control signal Vsout outputted by the "OR" operation circuit is completely the same as the BFI control signal Vsout received by the "OR" operation circuit. It should be noted that according to actual application demands, the second backlight signal may also not be the first cooperation signal (constant voltage signal) but a PWM signal with larger duty ratio, so as to improve the adjustment range of the display brightness of the display device employing the control method for the backlight. In this case, the control signal for the backlight outputted by the logical control circuit is different from the BFI control signal Vsout and the PWM signal, but the control signal for the backlight can still have certain brightness adjustment function (for example, brightness enhancement function) in the case of having smearing suppression function.

For example, when the display mode is the second display mode (for example, brightness adjustment mode), the second backlight signal is allowed to be the first cooperation signal or the PWM signal based on a second control signal, and the duty ratio of the PWM signal is adjusted based on the second control signal (for example, adjusted between 0% and 100%); the PWM signal is outputted through the second signal output terminal of the drive circuit of the display panel; the memory (for example, the register) of the drive circuit of the display panel may output the pre-stored second cooperation signal from the first signal output terminal of the drive circuit of the display panel; and the second cooperation signal is substantially a constant voltage signal (for example, a high voltage level signal or a low voltage level signal). For example, the second cooperation signal (for example, high voltage level signal) and the PWM signal are respectively provided to the first signal input terminal and the second signal input terminal of the "AND" operation circuit via the first signal output terminal of the drive circuit and the second signal output terminal of the drive circuit. Thus, the PWM signal taken as the control signal for the backlight can be generated after the "AND" operation circuit performs "AND" operation on the second cooperation signal (for example, high voltage level signal) and the PWM signal. For example, in this case, the PWM signal outputted by the "AND" operation circuit is exactly the same with the PWM signal received by the "AND" operation circuit. For another example, the second cooperation signal (for example, low voltage level signal) and the PWM signal are respectively provided to the first signal input terminal and the second signal input terminal of the "OR" operation circuit via the first signal output terminal of the drive circuit and the second signal output terminal of the drive circuit. Thus, the PWM signal taken as the control signal for the backlight can be generated after the "OR" operation circuit performs "OR" operation on the second cooperation signal (for example, low voltage level signal) and the PWM signal. For example, in this case, the PWM signal outputted by the "OR" operation circuit is exactly the same with the PWM signal received by the "OR" operation circuit. For example, the pulse width of the PWM signal is adjustable before output from the drive circuit (or output from the image processor), and is a fixed value after output from the drive circuit (or output from the image processor).

For example, before generating the control signal for the backlight based on the first backlight signal and the second backlight signal, the control method further comprises: acquiring the display mode of the display panel. For example, the display mode of the display panel may be acquired according to an instruction signal of the user or a video signal to be displayed. For example, the image processor may be configured to: receive the instruction signal of the user or the video signal to be displayed; acquire the display mode of the display panel according to the instruction signal of the user or the video signal to be displayed; generate the first control signal and the second control signal according to the display mode of the display panel; and generate the second backlight signal based on the second control signal.

For example, the control method for the backlight further comprises: controlling the brightness of the backlight and the starting time point of allowing the backlight to be turned on (or the overall time of allowing the backlight to be turned on in one frame of image) according to the display mode of the display panel provided with the backlight. Here, the brightness of the backlight refers to the average brightness of the backlight in unit time, and the starting time point of allowing the backlight to be turned on refers to the starting time point of the time period of allowing the backlight to be turned on (for example, the T1 time point as illustrated in FIG. 8). For example, in the first mode, the starting time point of allowing the backlight to be turned on may be later than 75% of the time of one frame of image, and the overall time of allowing the backlight to be turned on is less than or equal to 25% of the time of one frame of image. In the second mode, the starting time point of allowing the backlight to be turned on is not later than 50% of the time of one frame of image (for example, not later than 10% of the time of one frame of image), and the overall time of allowing the backlight to be turned on is not less than 50% of the time of one frame of image. For example, by simultaneously controlling the brightness of the backlight and the starting time point of allowing the backlight to be turned on (or the overall time of allowing the backlight to be turned on within one frame of image) according to the display mode of the display panel provided with the backlight, the display device employing the control method for the backlight can optimize the display effect according to the display mode of the display device, and then can improve the overall display effect of the display device.

At least one embodiment of the present disclosure further provides a display method, which comprises: executing the control method for the backlight provided by any embodiment of the present disclosure to acquire the control signal for the backlight; and driving the backlight based on the control signal for the backlight to enable the display panel to perform display operation.

At least one embodiment of the present disclosure further provides a control device for a backlight. The control device for the backlight is configured to: generate a control signal for the backlight based on a first backlight signal and a second backlight signal. The first backlight signal is different from the second backlight signal.

For example, the control device for the backlight is also configured to: control the first backlight signal and the second backlight signal according to the display mode of a display panel provided with the backlight to enable the control signal for the backlight to be switched between a BFI control signal and a brightness control signal.

For example, the specific method of controlling the first backlight signal and the second backlight signal according to the display mode of the display panel provided with the backlight to enable the control signal for the backlight to be switched between the BFI control signal and the brightness control signal may refer to a corresponding example of the control method for the backlight, so no further description will be given here.

Figure 9:
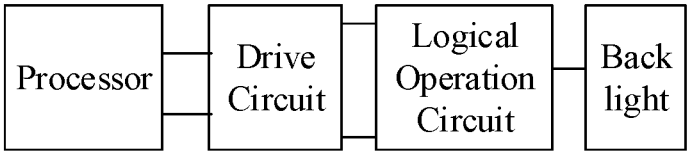
FIG. 9 is an exemplary block diagram of a control device for a backlight provided by at least one embodiment of the present disclosure.

FIG. 9 illustrates a control device for a backlight. As illustrated in FIG. 9, the control device for the backlight comprises a processor (for example, an image processor), a logical operation circuit and a drive circuit.

As illustrated in FIG. 9, the processor is configured to generate a first control signal; the drive circuit includes a first signal input terminal, a second signal input terminal, a first signal output terminal and a second signal output terminal; the first signal input terminal of the drive circuit is configured to receive a first control signal, and the second signal input terminal of the drive circuit is configured to receive the second backlight signal; the drive circuit is configured to at least generate the first backlight signal based on the first control signal; the first signal output terminal of the drive circuit is connected with a first signal input terminal of the logical operation circuit, so as to provide the first backlight signal to the first signal input terminal of the logical operation circuit; the second signal output terminal of the drive circuit is connected with a second signal input terminal of the logical operation circuit, so as to provide the second backlight signal to the second signal input terminal of the logical operation circuit; the logical operation circuit is configured to generate the control signal for the backlight by utilization of logical operation based on the first backlight signal and the second backlight signal; and a signal input terminal of the backlight is connected with a signal output terminal of the logical operation circuit, so as to receive the control signal for the backlight. For example, the logical operation circuit is an "OR" operation circuit or an "ADN" operation circuit.

It should be noted that the first backlight signal and the second backlight signal are not limited to be provided by the same element of the display panel (for example, the drive circuit of the display panel), and may also be respectively provided by different elements of the display panel (for example, respectively provided by the drive circuit and the image processor of the display panel) according to actual application demands. In this case, the image processor is directly connected with the second signal input terminal of the logical operation circuit, and the second signal output terminal of the drive circuit is not connected with the second signal input terminal of the logical operation circuit.

For example, the processor is, for example, a graphics processing unit (GPU) or a processing unit of other forms having data processing capability and/or instruction execution capability. For example, the processor may be implemented as a general purpose processor, and may be also a single chip microcomputer, a microprocessor, a digital signal processor (DSP), a dedicated image processing chip, or a field programmable logic array (FPLA).

For example, the image processor may be configured to: receive an instruction signal of a user or a video signal to be displayed; acquire the display mode of the display panel according to the instruction signal of the user or the video signal to be displayed; generate the first control signal and the second control signal according to the display mode of the display panel; and generate the second backlight signal based on the second control signal.

At least one embodiment of the present disclosure further provides another display device, which comprises the control device for the backlight provided by any embodiment of the present disclosure.

Detailed description will be given below to the display method (the display method of a video) provided by at least one embodiment of the present disclosure with reference to FIGS. 1 to 6.

Figure 2:
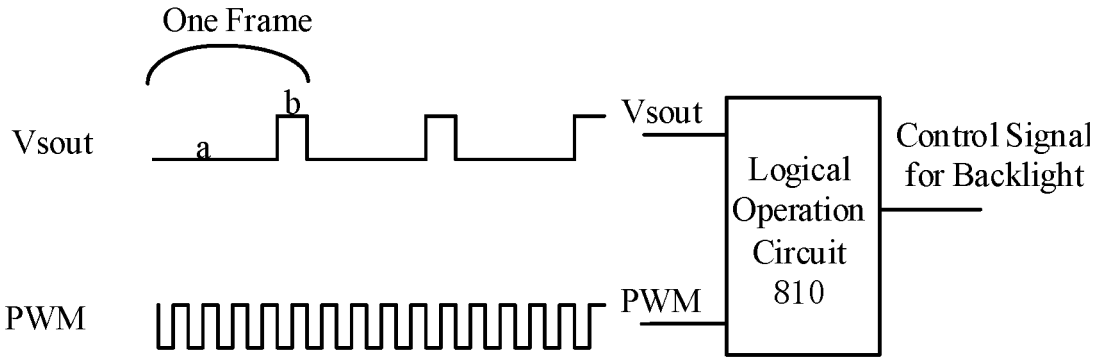
FIG. 2 is a schematic diagram of a control method and a display method of a backlight provided by at least one embodiment of the present disclosure.

FIGS. 1 and 2 are an example of the display method (the display method of the video) provided by at least one embodiment of the present disclosure. As illustrated in FIGS. 1 and 2, the video display method provided by at least one embodiment of the present disclosure comprises the following steps S10 and S20.

S10: acquiring the display mode of a display panel (a display panel for displaying the video).

For example, the display panel includes a liquid crystal layer and a backlight which is configured to emit display light towards the liquid crystal layer. After a voltage is applied to the liquid crystal layer, liquid crystal molecules in the liquid crystal layer can be driven to rotate. After the rotation of the liquid crystal molecules are completed (namely the liquid crystal molecules stop rotating), the backlight is turned on (that is, the backlight is in the light-emitting state), and then the display function can be realized. In some examples or embodiments, the display mode may include a first mode (for example, a smearing suppression mode) and a second mode (for example, a brightness adjustment mode). The first mode may be a game mode and the second mode may be a movie mode.

For example, before acquiring the display mode, the following steps may be executed: switching the display mode of the display panel according to the received user instruction; and switching the display mode of the display panel to be the first mode if the instruction signal is a first signal, and switching the display mode of the display panel to be the second mode if the instruction signal is a second signal, that is, the display mode of the display panel may be manually switched by the user. For another example, the display mode of the display panel may also be automatically switched. For example, before acquiring the display mode, the following step may be executed: switching the display mode of the display panel according to the category of the source of the video (for example, an application for playing the video). For example, the method of automatically switching the display mode of the display panel may include: acquiring the category of the source of the video (for example, the application for playing the video); and switching the display mode of the display panel to be the first mode if the application for playing the video is a first category (e.g., video player category), and converting the display mode of the display panel to be the second mode if the application for playing the video is a second category (e.g., game program category).

S20: adopting (for example, switching), according to the display mode of the display panel, the BFI control signal Vsout or the brightness control signal PWM to drive the backlight of the display panel.

For example, the step S20 includes: generating the control signal for the backlight based on the first backlight signal and the second backlight signal. The first backlight signal is different from the second backlight signal. For example, the step of generating the control signal for the backlight based on the first backlight signal and the second backlight signal may be implemented by a logical operation circuit 810 as illustrated in FIG. 2.

For example, if the display mode is the first mode, the BFI control signal Vsout is adopted (for example, switched) to drive the backlight of the display panel. As illustrated in FIG. 2, the BFI control signal Vsout has a BFI period a and a display period b for driving each frame of the video. In the BFI period, the BFI control signal Vsout outputs a second voltage level (for example, a low voltage level), and the backlight of the display panel does not emit light, so the display panel is in a black screen state. In the display period, the BFI control signal Vsout outputs a first voltage level (for example, a high voltage level, the voltage value of the first voltage level is higher than the voltage value of the second voltage level), and the backlight of the display panel emits light, so the display panel is in a display state. For example, the BFI period may be at the forepart of each frame of image and the display period may be at the latter stage of each frame of image, that is, the BFI period is before the display period. For example, in the process of applying voltage to the liquid crystal molecules of the liquid crystal layer to realize the rotation of the liquid crystal molecules, if the display panel is in the display state, the user (for example, the eyes of the user) may have spinning sensation. Because the BFI period is at the forepart of each frame of image and the display period is at the latter stage of each frame of image (for example, the backlight is turned off in the rotation process of the liquid crystal molecules), the display panel will be in the black screen state in the rotation process of the liquid crystal molecules, and then the spinning sensation of the user can disappear. In addition, because the backlight is turned off in the rotation process of the liquid crystal molecules, the smearing problem of the display panel can also be suppressed, so the immersion of the user on an image (for example, a game image) displayed by the display panel can be further improved. For example, the display period occupies 5%-25%, for example, 10%, 15% or 20%, of the viewing time of each frame of image. For example, the brightness control signal PWM may be a PWM signal with an adjustable duty ratio. The brightness of the backlight of the display panel is adjusted by adjustment of the duty ratio of the PWM signal. When the duty ratio is larger, the display brightness of the display panel is higher. When the duty ratio is smaller, the display brightness of the display panel is lower.

For example, in the process of adopting the display panel to display the video, the display mode of the display panel may be acquired, and the BFI control signal Vsout or the brightness control signal PWM is adopted (for example, switched), according to the display mode of the display panel, to drive the backlight of the display panel. For example, when the display mode is the movie mode, the brightness control signal PWM may be adopted (for example, switched) to drive display, so as to satisfy the requirement of high brightness. When the display mode is the game mode, the BFI control signal Vsout may be adopted (for example, switched) to drive the display panel, so as to suppress the smearing phenomenon of the display device (for example, a VR head-mounted display device) in the related art, and improve the video experience of game users.

It should be noted that the display mode of the display panel may also be directly acquired according to the instruction signal of the user or the video signal to be displayed before adopting the display panel to display the video. In this case, the display mode of the display panel is not required to be switched before acquiring the display mode of the display panel.

For example, the BFI control signal Vsout may be outputted by a first processing unit (for example, a video processor for processing video signals); the control signal for the backlight may be outputted by a second processing unit (e.g., a backlight processor for processing the backlight); the step S20 may include: allowing (controlling) the backlight signal (namely the first backlight signal) outputted by the first processing unit to be the BFI control signal Vsout if the display mode is the first mode, and acquiring the BFI control signal Vsout, so as to drive the backlight of the display panel; and allowing (controlling) the backlight signal (namely the second backlight signal) outputted by the second processing unit to be the brightness control signal PWM, and acquiring the brightness control signal PWM, so as to drive the backlight of the display panel.

For example, the step S20 may be implemented by the following method. If the display mode is the first mode, the backlight signal (namely the first backlight signal) outputted by the first processing unit is controlled to be the BFI control signal Vsout; the backlight signal (namely the second backlight signal) outputted by the second processing unit is controlled to be the first cooperation signal; and the first cooperation signal and the BFI control signal Vsout are configured for obtaining the control signal for the backlight based on a pre-defined algorithm. In this case, the control signal for the backlight is the BFI control signal Vsout.

If the display mode is the second mode, the backlight signal outputted by the first processing unit is controlled to be the second cooperation signal, and the backlight signal outputted by the second processing unit is controlled to be the brightness control signal PWM; and the control signal for the backlight is obtained through calculating with the pre-defined algorithm according to the backlight signal (namely the first backlight signal) outputted by the first processing unit and the backlight signal (namely the second backlight signal) outputted by the second processing unit, so as to drive the backlight of the display panel based on the control signal for the backlight. The BFI control signal Vsout and the first cooperation signal are configured to obtain the control signal for the backlight through calculating with the pre-defined algorithm; in this case, the control signal for the backlight is the BFI control signal Vsout. The brightness control signal PWM and the second cooperation signal are configured to obtain the control signal for the backlight through calculating with the pre-defined algorithm, and the control signal for the backlight is the brightness control signal PWM.

It should be noted that the first backlight signal and the second backlight signal are not limited to be respectively provided by the first processing unit and the second processing unit; and according to actual application demands, the first backlight signal and the second backlight signal may also be provided by the same element of the display panel (for example, the drive circuit of the display panel), or respectively provided by different elements of the display panel (for example, respectively provided by the drive circuit and the image processor of the display panel).

Figure 3:
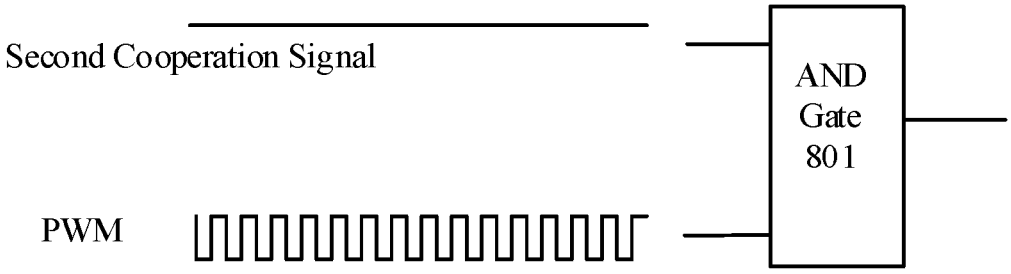
FIG. 3 is a schematic diagram of a display panel adopting another control method and another display method of a backlight provided by at least one embodiment of the present disclosure when the display mode of the display panel is a second mode.
Figure 4:
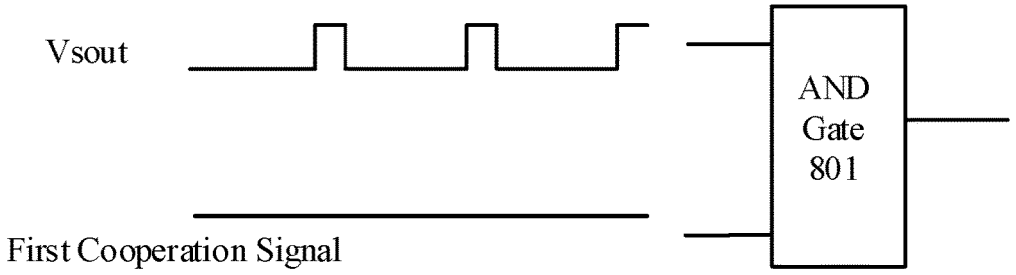
FIG. 4 is a schematic working diagram of a display panel adopting another control method and another display method of a backlight provided by at least one embodiment of the present disclosure when the display mode of the display panel is a first mode.

In some examples or embodiments, as illustrated in FIGS. 3 and 4, the first cooperation signal is at the first voltage level (high voltage level); the second cooperation signal is at the first voltage level; the pre-determined algorithm is an AND gate algorithm; the backlight signal outputted by the first processing unit and the backlight signal outputted by the second processing unit are taken as two input parameters of the AND gate algorithm; and an output parameter of the AND gate algorithm is the control signal for the backlight. For example, as for the AND gate algorithm, when all the input parameters are simultaneously the first voltage level (logic 1), the output parameter is the first voltage level, or else the output parameter is low voltage level (logic 0). For example, the pre-determined algorithm may be implemented by an AND gate 801. For example, the backlight signal outputted by the first processing unit and the backlight signal outputted by the second processing unit may be taken as input signals of the AND gate 801, and an output signal of the AND gate 801 may be served as the control signal for the backlight.

Figure 5:
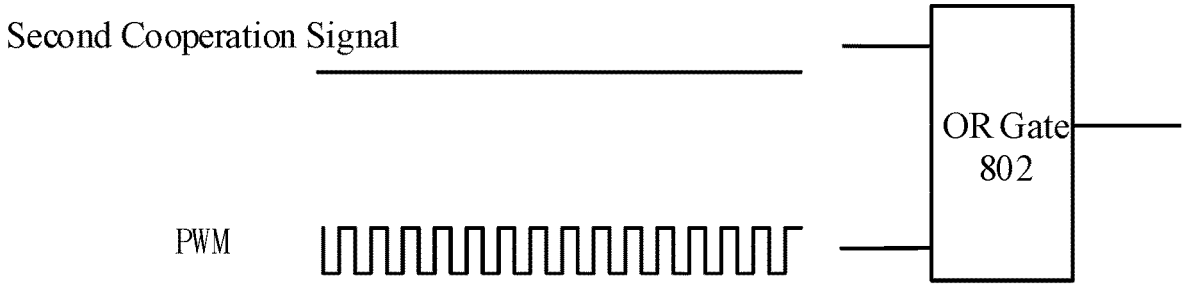
FIG. 5 is a schematic working diagram of a display panel adopting still another control method and still another display method of a backlight provided by at least one embodiment of the present disclosure when the display mode of the display panel is a second mode.
Figure 6:
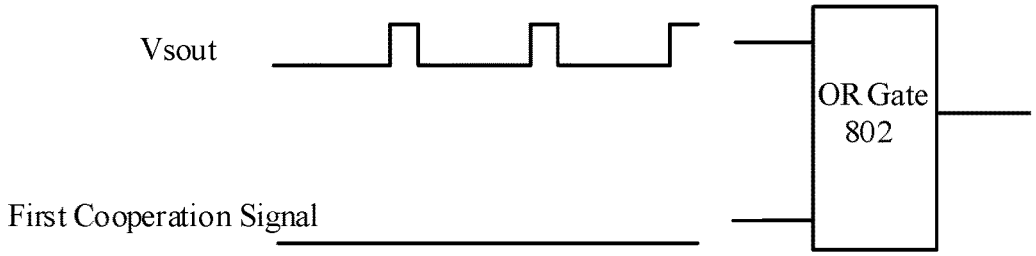
FIG. 6 is a schematic working diagram of a display panel adopting still another control method and still another display method of a backlight provided by at least one embodiment of the present disclosure when the display mode of the display panel is a first mode.

In some other examples or embodiments, as illustrated in FIGS. 5 and 6, the first cooperation signal is a low voltage level; the second cooperation signal is a low voltage level; the pre-determined algorithm is an OR gate algorithm; the backlight signal outputted by the first processing unit and the backlight signal outputted by the second processing unit are taken as two input parameters of the OR gate algorithm; and an output parameter of the OR gate algorithm is the control signal for the backlight. For example, as for the OR gate algorithm, the output parameter is the first voltage level (logic "1") as long as one of all the input parameters is the first voltage level (logic "1"); and the output parameter is low voltage level (logic "0") only when all the input parameters are low voltage level (logic "0"). For example, the pre-determined algorithm may be implemented by an OR gate 802. For example, the backlight signal outputted by the first processing unit and the backlight signal outputted by the second processing unit may be taken as input signals of the OR gate 802, and an output signal of the OR gate 802 may be served as the control signal for the backlight.

For example, the AND gate algorithm and the OR gate algorithm may be implemented by software, firmware, hardware or any combination thereof. For example, the hardware includes an FPGA, etc. For example, the AND gate algorithm may be implemented by a logical circuit (an AND gate circuit), and the OR gate algorithm may be implemented by a logical circuit (an OR gate circuit).

Figure 7:
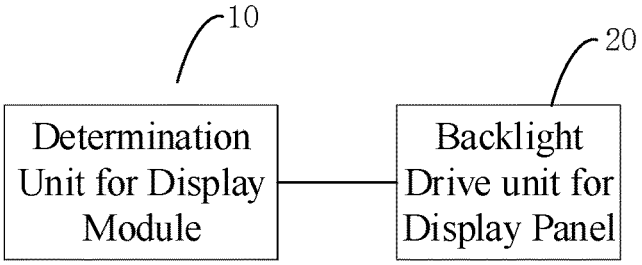
FIG. 7 is a schematic block diagram of a display panel provided by at least one embodiment of the present disclosure.

FIG. 7 is an example of a display device provided by at least one embodiment of the present disclosure. The display device provided by an embodiment of the present disclosure may be: a display panel, electronic paper, a mobile phone, a tablet PC, a TV, a display, a notebook PC, a digital photo frame, a navigator, a VR head-mounted display device or any product or component with display function.

As illustrated in FIG. 7, the display device comprises a determination unit (for example, a determination unit 10 for a display module) and a backlight drive unit (a backlight drive unit 20 for a display panel).

The determination unit 10 for the display module is configured to acquire the display mode of the display panel. The backlight drive unit 20 (the drive unit) for the display panel is configured to adopt (for example, switch), according to the display mode of the display panel, the BFI control signal Vsout or the brightness control signal PWM to drive the backlight of the display panel.

For example, in the process of adopting the display panel to display the video, the display mode of the display panel may be acquired, and the BFI control signal Vsout or the brightness control signal PWM is adopted (for example, switched), according to the display mode of the display panel, to drive the backlight of the display panel. For example, when the display mode is the movie mode, the brightness control signal PWM may be adopted (for example, switched) to drive display, so as to satisfy the requirement of high brightness. When the display mode is the game mode, the BFI control signal Vsout may be adopted (for example, switched) to drive the display panel, so as to suppress the smearing phenomenon of the display device (for example, the VR head-mounted display device) in the related art, and improve the video experience of game users.

For example, the display device may further comprise a display mode conversion unit. The display mode conversion unit is configured to convert the display mode of the display panel according to the received instruction signal of the user; or configured to convert the display mode of the display panel according to the source of the video.

It should be noted that the display mode of the display panel may also be directly acquired according to the instruction signal of the user or the video signal to be displayed before adopting the display panel to display the video. In this case, the display mode of the display mode is not required to be switched before acquiring the display mode of the display panel, that is, the display device does not need to arrange the display mode conversion unit.

For example, in the display device, the backlight drive unit for the display panel is configured to: control the backlight signal outputted by the first processing unit to be the BFI control signal Vsout and the backlight signal outputted by the second processing unit to be the first cooperation signal if the display mode is the first mode; the first cooperation signal and the BFI control signal Vsout are configured to obtain the control signal for the backlight through calculating with a pre-determined algorithm, and the control signal for the backlight is the BFI control signal Vsout. The backlight drive unit for the display panel is also configured to: control the backlight signal outputted by the first processing unit to be the second cooperation signal and the backlight signal outputted by the second processing unit to be the brightness control signal PWM if the display mode is the second mode; the backlight signal outputted by the first processing unit and the backlight signal outputted by the second processing unit are configured to obtain the control signal for the backlight through calculating with a pre-determined algorithm. The backlight drive unit for the display panel is also configured to: drive the backlight of the display panel based on the control signal for the backlight. The control signal for the backlight obtained, through calculating with the pre-determined algorithm, based on the BFI control signal Vsout and the first cooperation signal is the BFI control signal Vsout. The control signal for the backlight obtained, through calculating with the pre-determined algorithm, based on the brightness control signal PWM and the second cooperation signal is the brightness control signal PWM.

For example, in a display device, the first cooperation signal is a first voltage level; the second cooperation signal is a first voltage level; a pre-determined algorithm allows the backlight signal outputted by the first processing unit and the backlight signal outputted by the second processing unit to be taken as input signals of an AND gate; and allows an output signal of the AND gate to be taken as the control signal for the backlight. For example, a signal calculation module (a signal calculation unit) is an AND gate circuit; the backlight signal outputted by the first processing unit and the backlight signal outputted by the second processing unit are inputted into different input terminals of the AND gate circuit; and an output terminal of the AND gate circuit is connected with the backlight of the display panel.

For example, in a display device, the first cooperation signal is a low voltage level; the second cooperation signal is a low voltage level; a pre-determined algorithm allows the backlight signal outputted by the first processing unit and the backlight signal outputted by the second processing unit to be taken as input signals of an OR gate; and allows an output signal of the OR gate to be taken as the control signal for the backlight. For example, a signal calculation module is an OR gate circuit; the backlight signal outputted by the first processing unit and the backlight signal outputted by the second processing unit are inputted into different terminals of the OR gate circuit; and an output terminal of the OR gate circuit is connected with the backlight of the display panel.

For example, in the display device, the BFI control signal Vsout which is corresponding to each frame of video comprises the display period (for displaying each frame of video) and the BFI period, the BFI period is, for example, at the latter stage of each frame of image and occupies 5%-25% of the display time of each frame of image. The brightness control signal PWM is a PWM signal with an adjustable duty ratio.

For example, each of the display mode conversion unit, the first processing unit, the second processing unit, the backlight drive unit, the determination unit and the signal calculation module may be implemented by software, firmware, hardware or any combination thereof. For example, the hardware includes an FPGA, etc.

Although detailed description has been given above to the present disclosure with general description and embodiments, it shall be apparent to those skilled in the art that some modifications or improvements may be made on the basis of the embodiments of the present disclosure. Therefore, all the modifications or improvements made without departing from the spirit of the present disclosure shall all fall within the scope of protection of the present disclosure.

What are described above is related to the illustrative embodiments of the disclosure only and not limitative to the scope of the disclosure; the scopes of the disclosure are defined by the accompanying claims.

What is claimed is:

1. A display device, comprising:

a drive device for a backlight, wherein the drive device for the backlight is configured to generate a control signal for the backlight based on a first backlight signal and a second backlight signal, wherein the first backlight signal is different from the second backlight signal, and to control the first backlight signal and the second backlight signal according to a display mode of a display panel provided with the backlight, so as to enable the control signal for the backlight to be switched between a black frame insertion (BFI) control signal and a brightness control signal, and a determination unit, wherein the determination unit is configured to determine the display mode of the display panel;

the drive device for the backlight comprises: a first mode control unit, a second mode control unit, a signal calculation unit and a backlight drive circuit;

the first mode control unit is configured to control the first backlight signal to be the BFI control signal and the second backlight signal to be a first cooperation signal if the display mode is a first mode;

the second mode control unit is configured to control the first backlight signal to be a second cooperation signal and the second backlight signal to be the brightness control signal if the display mode is a second mode;

the signal calculation unit is configured to: obtain the control signal for the backlight through calculating with a pre-defined algorithm according to the first backlight signal and the second backlight signal, so as to enable the backlight to be capable of being driven based on the control signal for the backlight;

the BFI control signal and the first cooperation signal are configured to obtain the control signal, which is the BFI control signal, for the backlight through calculating with a pre-defined algorithm; and the brightness control signal and the second cooperation signal are configured to obtain the control signal, which is the brightness control signal, for the backlight through calculating with a pre-defined algorithm.

2. A control device for a backlight, wherein the control device for the backlight is configured to: generate a control signal for the backlight based on a first backlight signal and a second backlight signal, wherein the first backlight signal is different from the second backlight signal, wherein the control device comprises a processor, a logical operation circuit and a drive circuit, wherein the processor is configured to generate a first control signal;

the drive circuit comprises a first signal input terminal, a second signal input terminal, a first signal output terminal and a second signal output terminal;

the first signal input terminal of the drive circuit is configured to receive the first control signal, and the second signal input terminal of the drive circuit is configured to receive the second backlight signal;

the drive circuit is configured to generate the first backlight signal based on at least the first control signal;

the first signal output terminal of the drive circuit is connected with a first signal input terminal of the logical operation circuit, so as to enable the first backlight signal to be provided to the first signal input terminal of the logical operation circuit;

the second signal output terminal of the drive circuit is connected with a second signal input terminal of the logical operation circuit, so as to enable the second backlight signal to be provided the second signal input terminal of the logical operation circuit;

the logical operation circuit is configured to generate the control signal for the backlight by utilization of a logical operation based on the first backlight signal and the second backlight signal; and a signal input terminal of the backlight is connected with a signal output terminal of the logical operation circuit, so as to receive the control signal for the backlight.

3. The control device according to claim 2, wherein the control device for the backlight is further configured to: control the first backlight signal and the second backlight signal according to a display mode of a display panel provided with the backlight, so as to enable the control signal for the backlight to be switched between a black frame insertion (BFI) signal and a brightness control signal.

4. A display device, comprising: the control device for the backlight according to claim 2.

5. A control method for a backlight, comprising:

generating a control signal for the backlight based on a first backlight signal and a second backlight signal, wherein the first backlight signal is different from the second backlight signal, and controlling the first backlight signal and the second backlight signal according to a display mode of a display panel provided with the backlight, so as to enable the control signal for the backlight to be switched between a black frame insertion (BFI) control signal and a brightness control signal, wherein, if the display mode is a first mode, the first backlight signal is the BFI control signal and the second backlight signal is a first cooperation signal; generating the control signal for the backlight based on the first backlight signal and the second backlight signal comprises: executing a logical operation based on the BFI control signal and the first cooperation signal, wherein a result of the logical operation is the BFI control signal; and if the display mode is a second mode, the first backlight signal is a second cooperation signal and the second backlight signal is the brightness control signal; and generating the control signal for the backlight based on the first backlight signal and the second backlight signal comprises: executing a logical operation based on the second cooperation signal and the brightness control signal, wherein a result of the logical operation is the brightness control signal.

6. The control method according to claim 5, wherein the first backlight signal and the second backlight signal comprise at least one selected from a group consisting of the BFI control signal and the brightness control signal.

7. The control method according to claim 5, wherein voltage values of the first cooperation signal and the second cooperation signal are all at a first voltage level, and the logical operation is an "AND" operation; or voltage values of the first cooperation signal and the second cooperation signal are all at a second voltage level, and the logical operation is an "OR" operation, wherein a voltage value of the second voltage level is less than a voltage value of the first voltage level.

8. The control method according to claim 5, further comprising:

providing the first backlight signal and the second backlight signal to a logical operation circuit, wherein the logical operation circuit is configured to generate the control signal for the backlight by utilization of a logical operation based on the first backlight signal and the second backlight signal.

9. The control method according to claim 5, wherein controlling the first backlight signal and the second backlight signal according to the display mode of the display panel provided with the backlight comprises:

generating a first control signal and a second control signal according to the display mode.

10. The control method according to claim 9, wherein controlling the first backlight signal and the second backlight signal according to the display mode of the display panel provided with the backlight further comprises:

allowing a first signal receiving terminal of a drive circuit of the display panel to receive the first control signal; and allowing the drive circuit of the display panel to generate the first backlight signal based on at least the first control signal.

11. The control method according to claim 10, wherein allowing the drive circuit of the display panel to generate the first backlight signal based on at least the first control signal comprises:

allowing the drive circuit of the display panel to be configured to enable the first backlight signal to be switched between the BFI control signal and a second cooperation signal based on at least the first control signal.

12. The control method according to claim 11, wherein in a time period corresponding to each frame of image of the display panel, the BFI control signal is a single-pulse signal or a double-pulse signal;

a pulse duration period of the BFI control signal and a transmittance adjustment period of a liquid crystal cell of the display panel are not overlapped in time;

the second cooperation signal is a first constant voltage signal;

in a case where the BFI control signal is the single-pulse signal, a starting time point of the single-pulse signal is equal to or later than a transmittance adjustment end time point of the liquid crystal cell of the display panel;

in a case where the BFI control signal is the double-pulse signal, the double-pulse signal comprises a first pulse and a second pulse; an end time point of the first pulse is same as or panel; and a starting time point of the second pulse is equal to or later than a transmittance adjustment end time point of the liquid crystal cell of the display panel.

13. The control method according to claim 10, wherein the brightness control signal comprises a pulse width modulation (PWM) signal with an adjustable duty ratio; a first cooperation signal is a second constant voltage signal;

controlling the first backlight signal and the second backlight signal according to the display mode of the display panel provided with the backlight further comprises: adjusting the duty ratio of the PWM signal based on the second control signal; and the control method further comprises:

providing the brightness control signal to a second signal receiving terminal of the drive circuit of the display panel.

14. The control method according to claim 5, further comprising:

acquiring the display mode of the display panel before generating the control signal for the backlight based on the first backlight signal and the second backlight signal.

15. A display method, comprising:

executing the control method according to claim 5 to acquire the control signal for the backlight; and driving the backlight based on the control signal for the backlight to enable a display panel provided with the backlight to perform display operation.

* * * * *